US009993684B2

(12) United States Patent
Lin et al.

(10) Patent No.: US 9,993,684 B2
(45) Date of Patent: Jun. 12, 2018

(54) EXERCISE APPARATUS WITH TRAVEL PATH CONSTRAINING UNIT

(71) Applicant: Rexon Industrial Corp., Ltd., Taichung (TW)

(72) Inventors: Hung Chi Lin, Taichung (TW); Ming-Cheng Huang, Taichung (TW); Zong-Huan Wu, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 0 days. days.

(21) Appl. No.: 15/350,315

(22) Filed: Nov. 14, 2016

(65) Prior Publication Data

US 2017/0128772 A1 May 11, 2017

(30) Foreign Application Priority Data

Nov. 11, 2015 (TW) ..... 104137105 A

(51) Int. Cl.

| | |
|---|---|
| ***A63B 21/00*** | (2006.01) |
| ***A63B 22/06*** | (2006.01) |
| ***A63B 21/015*** | (2006.01) |
| ***A63B 22/00*** | (2006.01) |
| *A63B 21/22* | (2006.01) |
| *A63B 22/20* | (2006.01) |

(52) U.S. Cl.

CPC ..... *A63B 22/0664* (2013.01); *A63B 21/015* (2013.01); *A63B 22/001* (2013.01); *A63B 21/00069* (2013.01); *A63B 21/00072* (2013.01); *A63B 21/159* (2013.01); *A63B 21/225* (2013.01); *A63B 22/0015* (2013.01); *A63B 22/201* (2013.01); *A63B 2022/067* (2013.01); *A63B 2225/30* (2013.01)

(58) Field of Classification Search

None

See application file for complete search history.

(56) References Cited

U.S. PATENT DOCUMENTS

| | | | | |
|---|---|---|---|---|
| 6,004,244 | A * | 12/1999 | Simonson | A63B 21/153 482/51 |
| 6,361,476 | B1 * | 3/2002 | Eschenbach | A63B 22/001 482/51 |
| 6,994,656 | B2 * | 2/2006 | Liao | A63B 22/001 482/52 |
| 7,479,093 | B1 * | 1/2009 | Immordino | A63B 22/0002 482/52 |
| 7,691,034 | B2 * | 4/2010 | May | A63B 22/0012 482/52 |

(Continued)

*Primary Examiner* — Stephen R Crow

(74) *Attorney, Agent, or Firm* — Bacon & Thomas, PLLC

(57) ABSTRACT

An exercise apparatus includes a base frame, a swing unit including a pair of swing arms pivotally mounted at the base frame, a pedal unit pivotally mounted at the swing unit, a travel path constraining unit including a pivot axle pivotally connected to the base frame, a pair of upper crank arms respectively affixed to two opposite ends of the pivot axle in reverse directions and a pair of links respectively pivotally connected between the upper crank arms and the swing arms for limiting the swinging range of the swing unit, a first damping unit for providing a damping resistance to the pedal unit, and a second damping unit for providing a damping resistance to the swing arms.

7 Claims, 8 Drawing Sheets

(56) References Cited

U.S. PATENT DOCUMENTS

| | | | | |
|---|---|---|---|---|
| 7,794,361 | B2 * | 9/2010 | Wang | A63B 21/15<br>482/51 |
| 8,465,398 | B2 * | 6/2013 | Lee | A63B 21/225<br>482/52 |
| 8,992,364 | B2 * | 3/2015 | Law | F16H 19/08<br>475/33 |
| 2005/0085344 | A1 * | 4/2005 | Eschenbach | A63B 21/00178<br>482/51 |
| 2006/0293153 | A1 * | 12/2006 | Porth | A63B 22/001<br>482/52 |
| 2009/0011904 | A1 * | 1/2009 | Chuang | A63B 22/001<br>482/52 |

* cited by examiner

EXERCISE APPARATUS WITH TRAVEL PATH CONSTRAINING UNIT

BACKGROUND OF THE INVENTION

1. Field of the Invention

The present invention relates to fitness equipment technology and more particularly, to an exercise apparatus with travel path constraining unit that provides enhanced stability.

2. Description of the Related Art

U.S. Pat. No. 7,985,165 discloses an elliptical trainer, entitled "elliptical exercise machine", which comprises a base frame, a flywheel set pivotally mounted at the base frame, two swinging rods pivotally connected to the base frame, two pedal sets respectively pivotally connected to the bottom ends of the swinging rods, two rockers respectively pivotally connected between the pedal sets and the base frame, and two crank sets respectively pivotally connected between the flywheel set and the pedal sets.

When the user alternately steps on the pedal sets, the crank sets drive the flywheel set to rotate and to further produce a damping resistance, thereby achieving an exercising effect. Further, using the cranks set to move the pedal sets alternately back and forth allows the user to conducting stepping exercises. Further, the rockers mate with the pedal sets to create a back and forth swinging motion.

The aforesaid prior art elliptical trainer can achieve the expected purpose of exercise. In this design, the arrangement of the crank sets, pedal sets and rockers can constrain the travel path of the elliptical trainer. However, because the rockers are mounted at the rear side of the base frame, when the user operates the pedal sets to bias the swinging rods heavily, the rockers will bear a high stress, affecting structural stability and the lifespan of the elliptical trainer.

Further, subject to the arrangement that the flywheel set is mounted at the front side of the base frame and the crank sets are respectively pivotally connected between the flywheel set and the pedal sets, a damping resistance is produced when the pedal sets are being operated. However, since this elliptical trainer does not provide a damping design to impart a damping resistance to the swinging rods, the exercise effect is more limited.

SUMMARY OF THE INVENTION

The present invention has been developed in view of the aforementioned circumstances. It is one of the main objects of the present invention to provide an exercise apparatus having a travel path constraining unit, which constrains the travel path, to ensure high operating smoothness and stability.

To achieve this and other objects of the present invention, an exercise apparatus comprises a base frame, a swing unit, a pedal unit, a travel path constraining unit, a first damping unit, and a second damping unit. The base frame comprises a base, and an upright support fixedly mounted at the base. The swing unit comprises a pair of swing arms pivotally connected to the upright support and swingable back and forth relative to the upright support. Each swing arm comprises a tubular pivot connection portion pivotally connected to the upright support, and a swinging portion opposite to the tubular pivot connection portion. The pedal unit comprises a pair of stepping bars respectively pivotally connected to the swing arms. Each stepping bar comprises a front end portion pivotally connected to one respective swinging portion, and a rear end portion opposite to the front end portion. The travel path constraining unit comprises a pivot axle pivotally mounted at the base frame, a pair of upper crank arms respectively fixedly connected to two opposite ends of the pivot axle in reverse directions, and a pair of links respectively pivotally connected between the upper crank arms and the tubular pivot connection portions of the swing arms. The first damping unit is mounted at the base frame, and adapted for providing a damping resistance to the stepping bars. The second damping unit is mounted at the upright support, and adapted for providing a damping resistance to the swing arms.

Thus, the invention has the advantages of: subject to the matching arrangement between the travel path constraining unit, the base frame and the swing unit, the swinging range of the swing unit is constrained during the operation of the exercise apparatus, avoiding component damage and ensuring a high level of operating stability and safety. Further, the first damping unit and the second damping unit are adapted for providing a damping resistance to the stepping bars and the swing arms respectively, achieving enhanced exercise effects.

Other advantages and features of the present invention will be fully understood by reference to the following specification in conjunction with the accompanying drawings, in which like reference signs denote like components of structure.

DETAILED DESCRIPTION OF THE INVENTION

Figure 1:
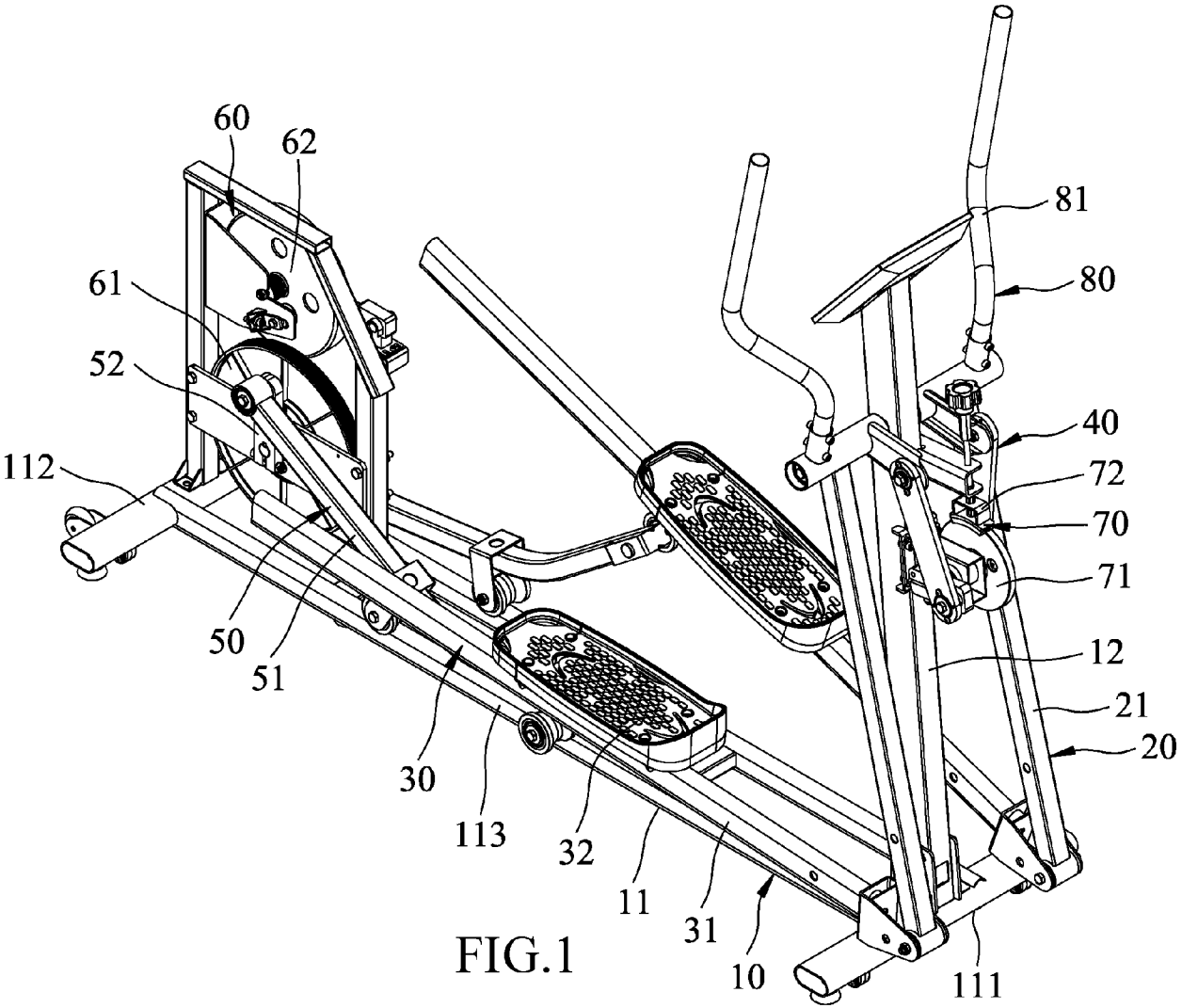
FIG. 1 is a perspective view of an exercise apparatus in accordance with the present invention.
Figure 2:
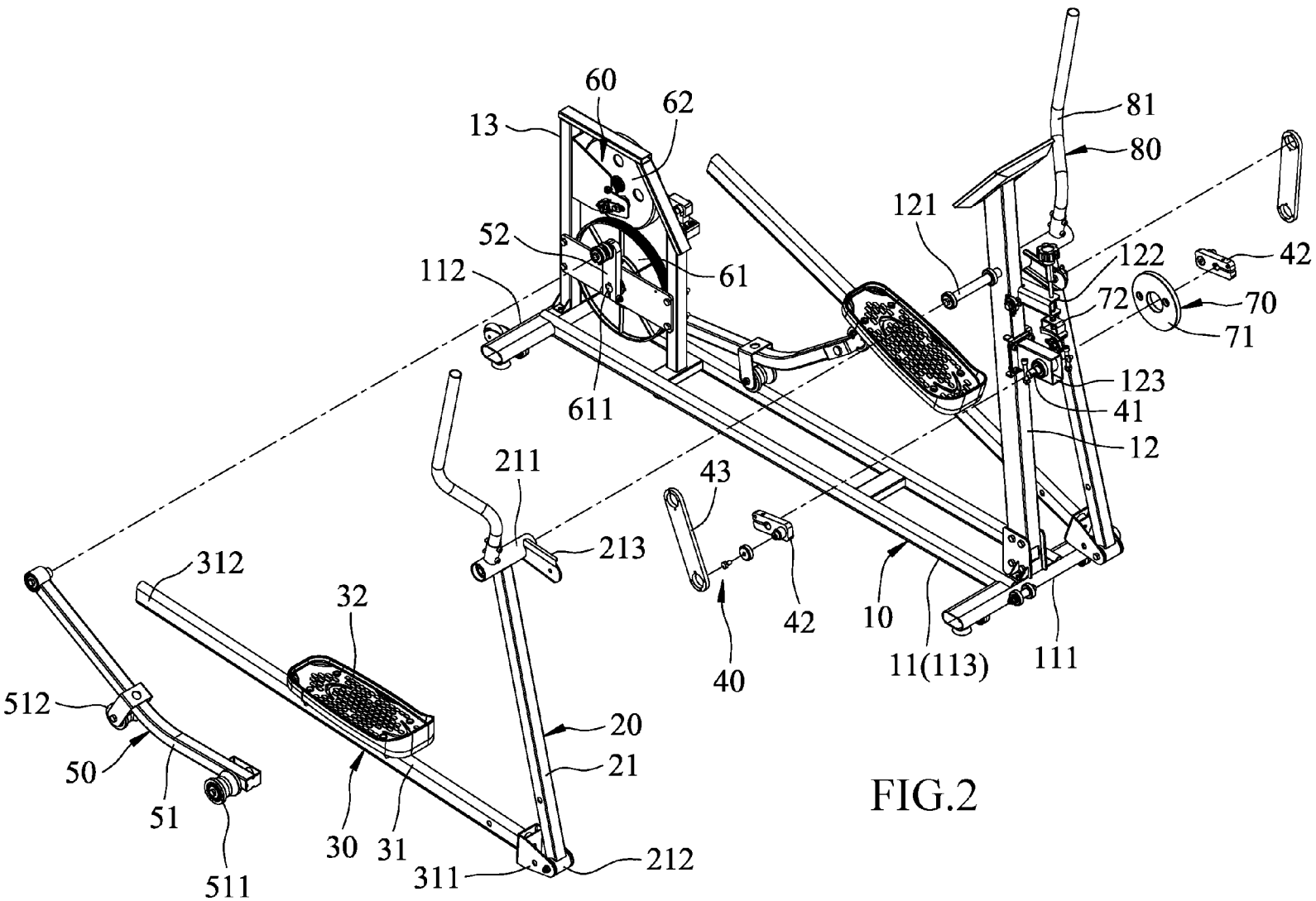
FIG. 2 is an exploded view of the exercise apparatus in accordance with the present invention.
Figure 3:
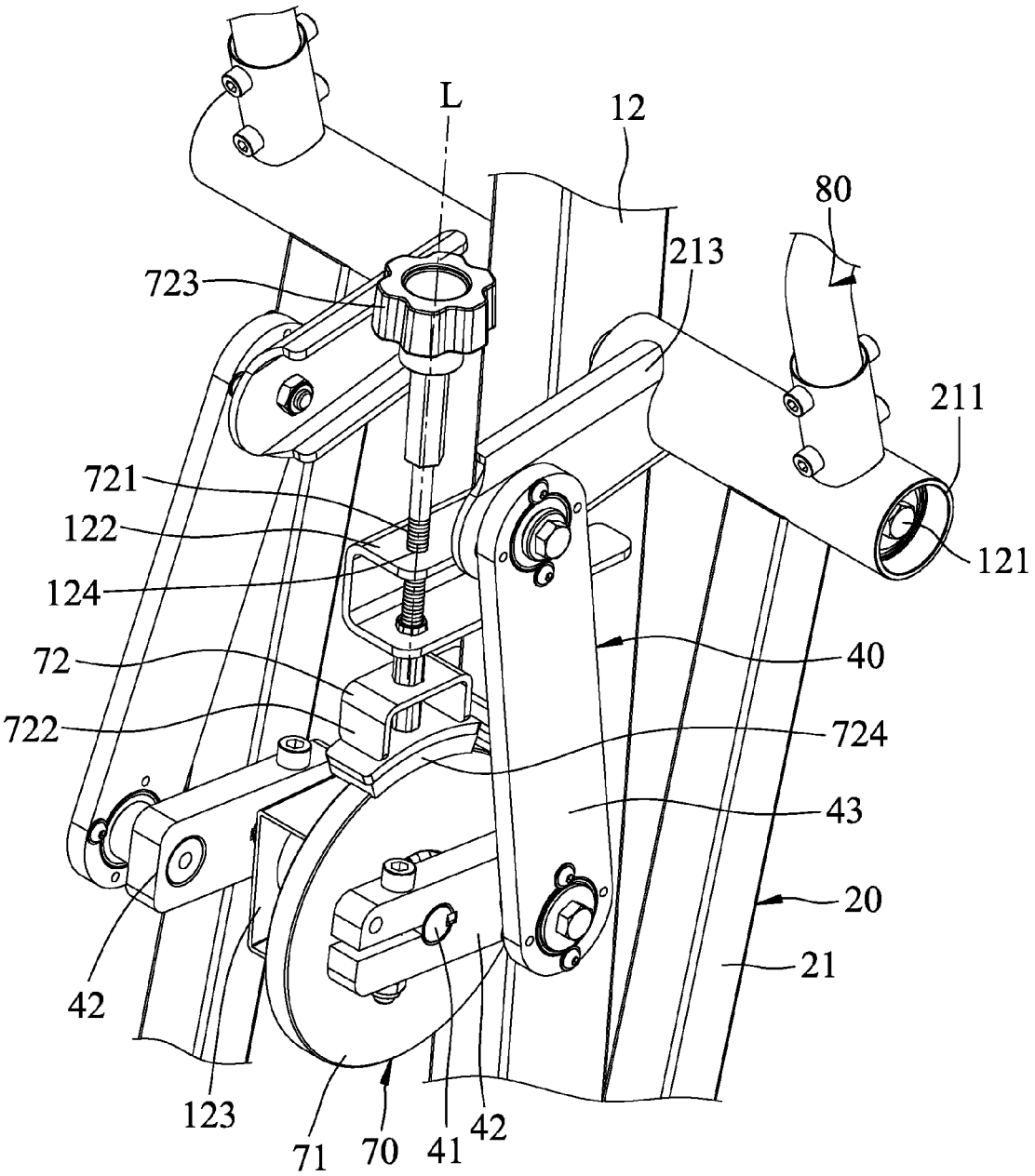
FIG. 3 is an enlarged elevational view of a part of the present invention, illustrating the arrangement of the travel path constraining unit and the second damping unit.
Figure 4:
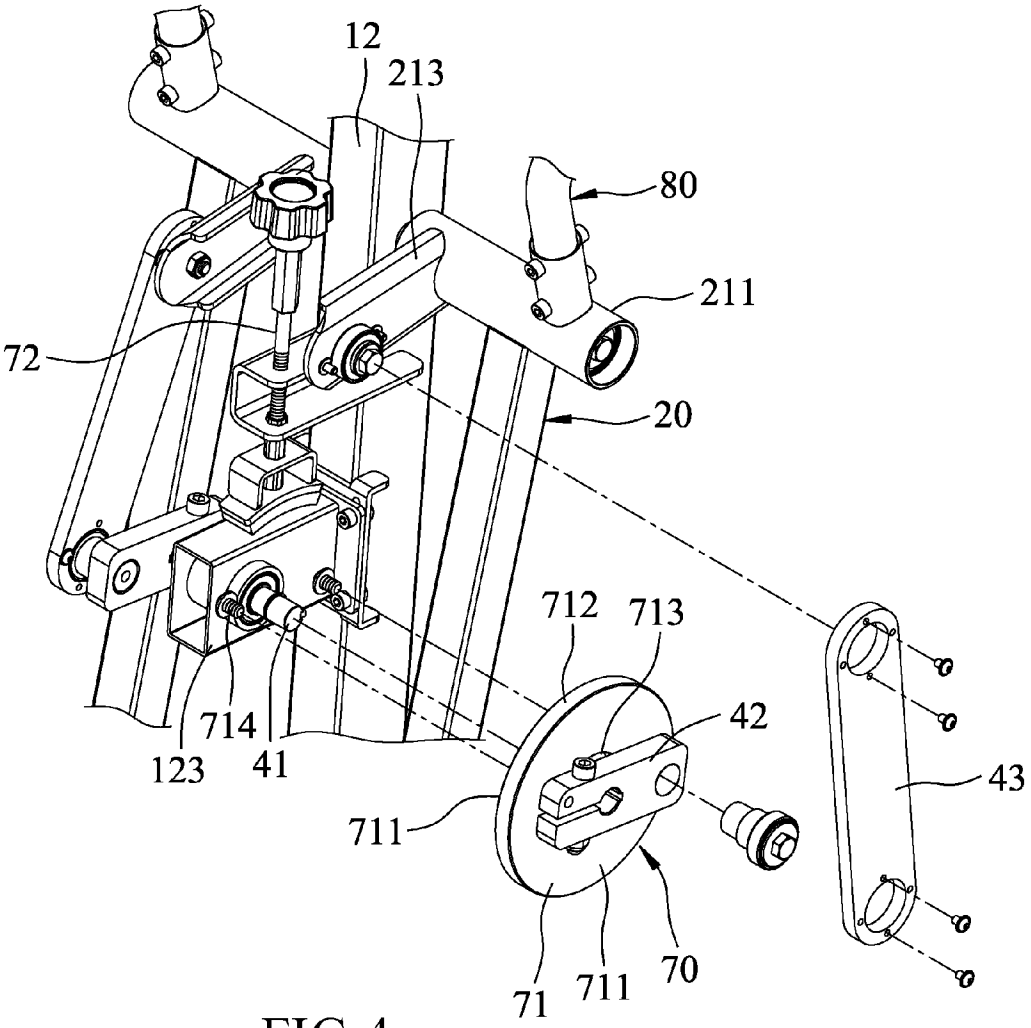
FIG. 4 is an enlarged exploded view of a part of the present invention, illustrating the mounting arrangement between the travel path constraining unit and the second damping unit.

Referring to FIGS. 1 and 2, an exercise apparatus with a travel path constraint unit in accordance with the present invention is shown. The exercise apparatus comprises a base frame 10, a swing unit 20, a pedal unit 30, a travel path constraining unit 40, an interlocking unit 50, a first damping unit 60, a second damping unit 70, and a handlebar unit 80.

Figure 6:
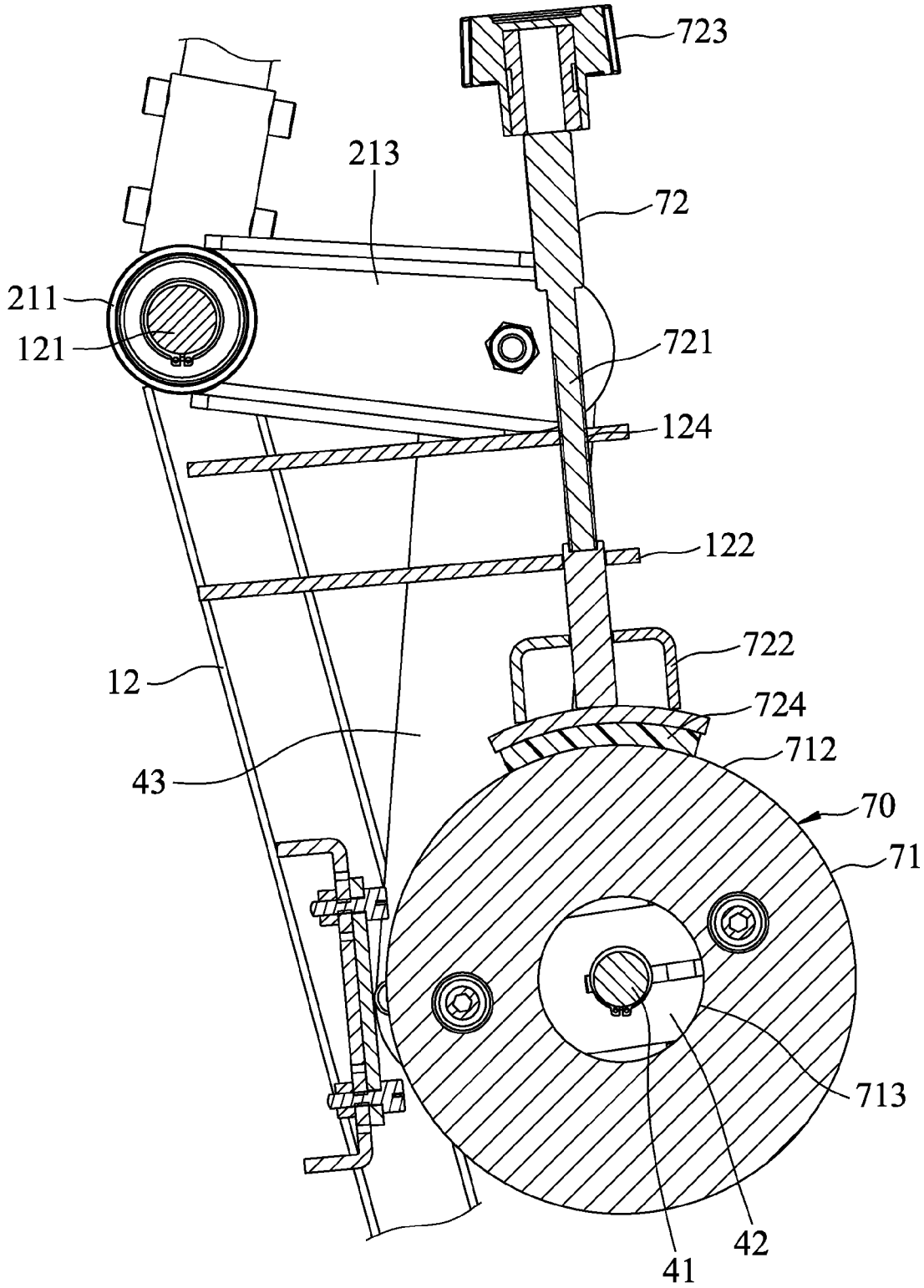
FIG. 6 is a sectional view taken along line VI-VI of FIG. 5.

The base frame 10 comprises a base 11, an upright support 12 fixedly mounted at one side of the base 11, and a mount 13 fixedly mounted at an opposite side of the base 11. The base 11 comprises a front side 111, a rear side 112 opposite to the front side 111, and a pair of guide rails 113 connected between the front side 111 and the rear bottom bar of the rear side 112. The upright support 12 is located at the front side 111 of the base 11, comprising a transverse axle 121 located at a top side thereof, a locating bar 122 disposed below the transverse axle 121, and an extension bar 123 downwardly extended from the locating bar 122. The locating bar 122 comprises a screw hole 124 (see FIG. 6). The mount 13 is mounted at the rear side 112 of the base 11.

The swing unit 20 comprises a pair of swing arms 21 axially pivotally connected to the transverse axle 121 of the upright support 12 and alternately movable back and forth relative to the base frame 10. Each swing arm 21 comprises a tubular pivot connection portion 211 located at one end thereof and pivotally connected to one end of the transverse axle 121, a swinging portion 212 located at an opposite end thereof, and a lug member 213 perpendicularly connected to the tubular pivot connection portion 211.

The pedal unit 30 comprises a pair of stepping bars 31 respectively pivotally connected to the swing arms 21 of the swing unit 20, and a pair of pedals 32 respectively mounted to the stepping bars 31. Each stepping bar 31 comprises a front end portion 311 pivotally connected to the swinging portion 212 of one respective swing arm 21, and an opposing rear end portion 312. The pedals 32 are respectively mounted, for example, by bolting, welding, screwing or other fastening device as known in the art, on the stepping bars 31 between the respective front end portions 311 and the respective rear end portions 312. Additionally, it is appreciated that the pedals 32 can be adjustably positioned or slidable along the respective stepping bars 31, for example, in adjusting holes positioned along the stepping bars 31 or sliding mount with tightening screws that tighten against the stepping bars 31.

The travel path constraining unit 40 is adapted for constraining the travel path of the swing arms 21, comprising a pivot axle 41 pivotally connected to the extension bar 123, a pair of upper crank arms 42 respectively fixedly connected to two opposite ends of the pivot axle 41 in reverse directions, and a pair of links 43 respectively pivotally connected between the upper crank arms 42 and the lug members 213.

The interlocking unit 50 comprises a pair of sliding bars 51 respectively slidable along the respective guide rails 113 of the base 11 of the base frame 10, and a pair of rear crank arms 52 respectively pivotally connected to the sliding bars 51. Each sliding bar 51 comprises a roller 511 located at one end thereof and stopped against a bottom side of one respective stepping bar 31, and a pulley 512 pivotally mounted at a middle part thereof and movably supported on the respective guide rail 113, for example, a wheel rollable along the respective guide rail.

The first damping unit 60 is mounted in the mount 13 of the base frame 10 for providing a damping resistance to the stepping bars 31, comprising a rotating wheel 61 mounted in the mount 13 and a damping wheel 62 pivotally mounted in the mount 13 and rotatable by the rotating wheel 61. The rotating wheel 61 comprises a rotating axle 611 axially located at the center of the rotating wheel 61 and pivotally mounted in the mount 13. The rear crank arms 52 are respectively and fixedly connected, for example, by bolts or other fastening device, with respective one ends thereof to the two opposite ends of the rotating axle 611.

Referring to FIGS. 3-6, the second damping unit 70 is mounted at the upright support 12 for providing a damping resistance to the swing arms 21, comprising a turntable 71 connected to at least one of the upper crank arms 42 and a friction device 72 for rubbing against the turntable 71 to generating a damping resistance. The friction device 72 can be positioned relative to the base frame 10.

The turntable 71 is a disk, which can be a hollow or solid disk, comprising two opposing end faces 711, a peripheral wall 712 connected between the two opposite end faces 711 and a through hole 713 cut through the two opposite end faces 711 at the center. The turntable 71 is disposed at one side of the extension bar 123, and fixedly fastened to one of the upper crank arms 42 with screws, or bolts, 714. Further, the through hole 713 is adapted for the insertion of the pivot axle 41.

In this embodiment, the friction device 72 is adjustably threaded into the locating bar 122, comprising a screw rod 721 threaded into the screw hole 124 of the locating bar 122 and extending along a center line L, a friction pad 722 connected to one end of the screw rod 721 to face toward the peripheral wall 712 of the turntable 71 and an adjustment member 723 fixedly connected to an opposite end of the screw rod 721. Further, the center line L is parallel to the end faces 711. Further, the friction pad 722 comprises a brake lining 724 abutted against the peripheral wall 712.

The handlebar unit 80 comprises two handlebars 81 respectively connected to the tubular pivot connection portions 211 of the swing arms 21.

Figure 7:
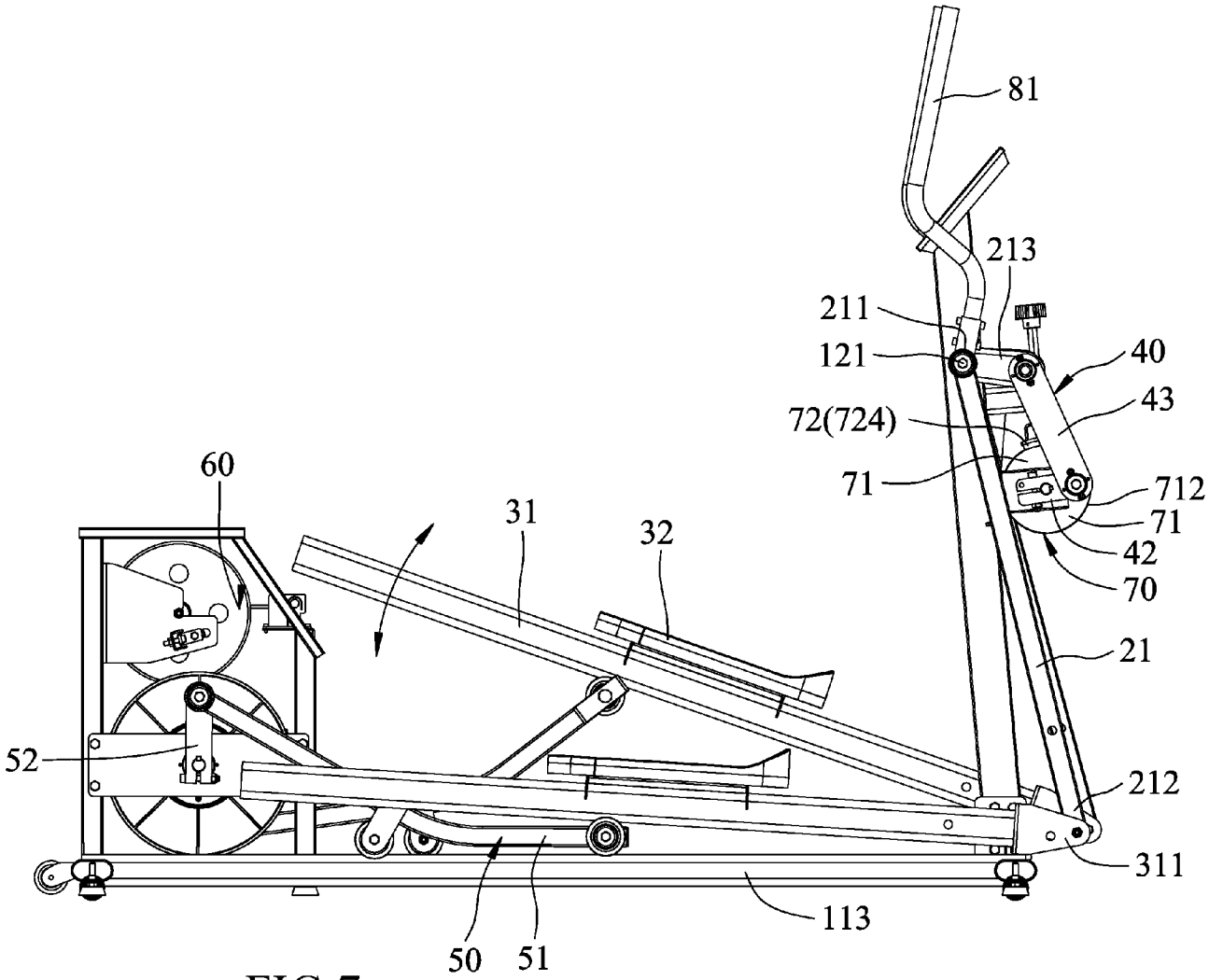
FIG. 7 is a schematic operational view of the present invention illustrating the stepping bars of the pedal unit moved in a free stepping mode.

When an user uses the exercise apparatus to carry out an operating mode of free stepping, as shown in FIG. 7, the user's legs are used to force the pedals 32 and the stepping bars 31 vertically downwards in an alternating manner. At this time, the stepping bars 31 do not push the pedals 32 forward but simply force the respective sliding bars 51 to move alternately back and forth along the respective guide rails 113. At the same time, the rear crank arms 52 are used to drive the rotating wheel against the first damping unit 60, where a damping resistance is generated, achieving the purpose of a stepping exercise.

Figure 5:
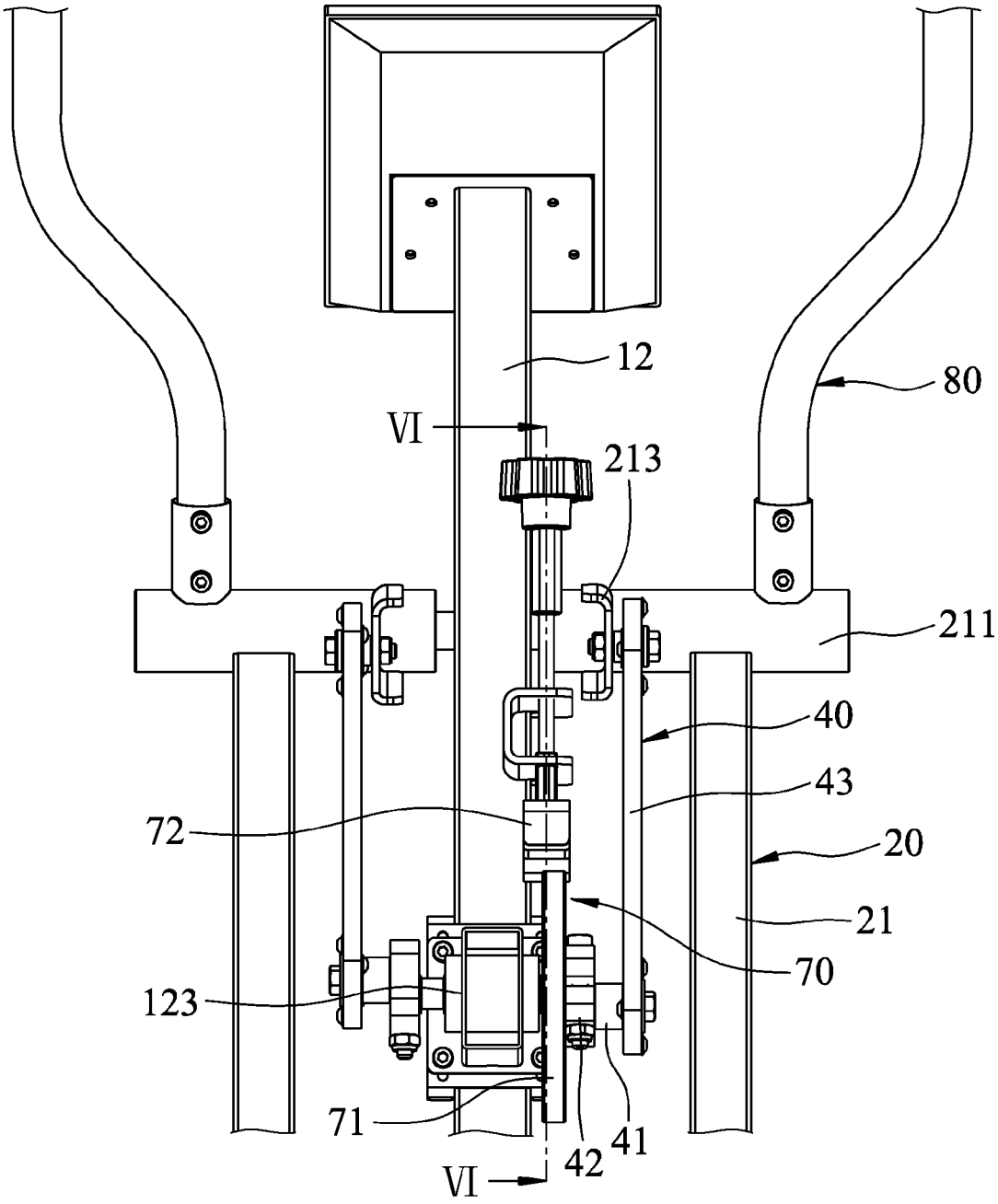
FIG. 5 is a schematic plain view of a part of the present invention, illustrating the relationship between the travel path constraining unit and the second damping unit.
Figure 8:
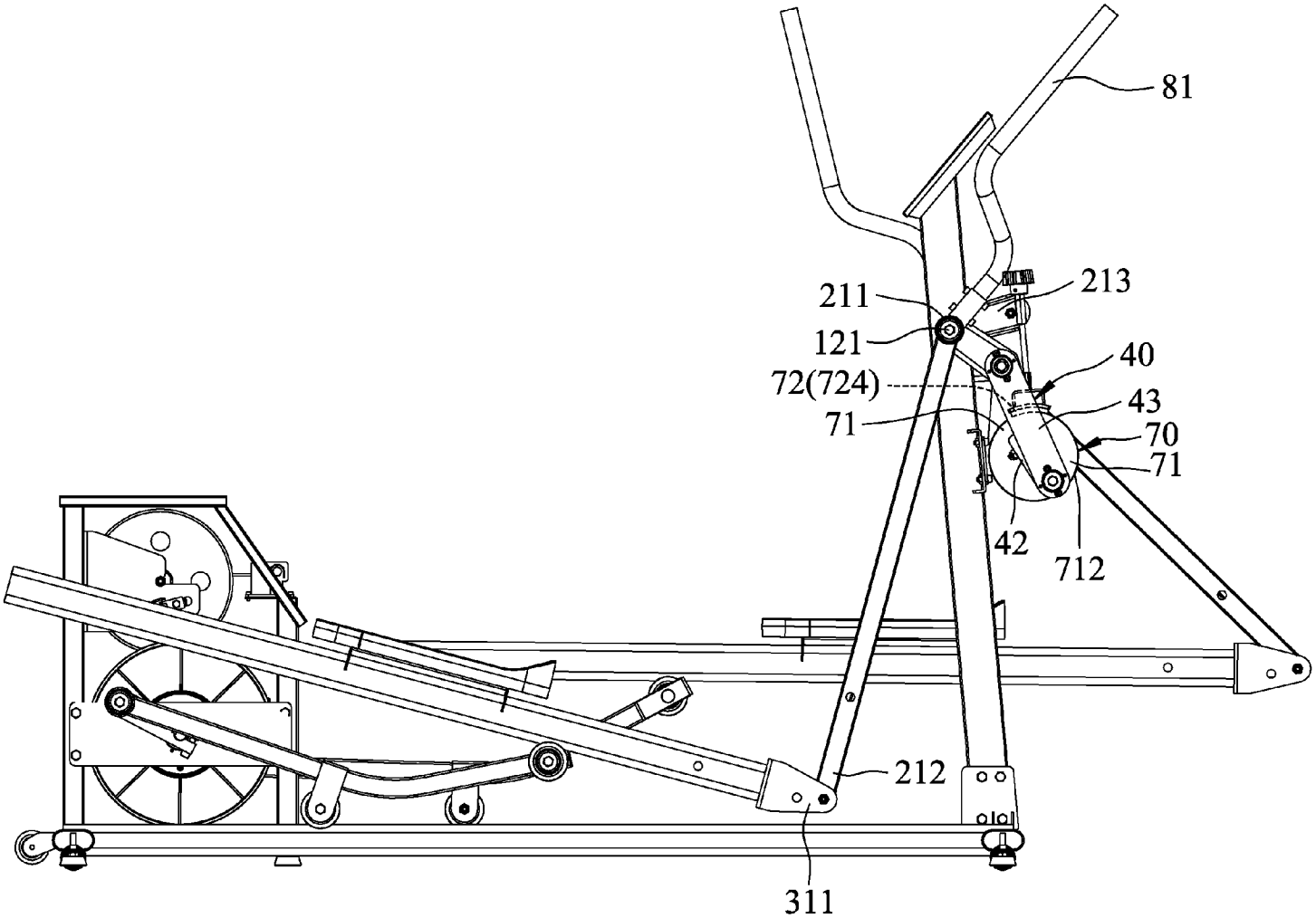
FIG. 8 is a schematic operational view of the present invention illustrating the stepping bars of the pedal unit moved in a sliding mode.

When the user uses the exercise apparatus to carry out an operating mode of a sliding exercise, as shown in FIG. 8, the user's legs are used to force the pedals 32 and the stepping bars 31 horizontally forwards (and/or the user's arms are used to force the swing arms in a forward and backward direction) in an alternating manner, where the rear crank arms 52 do not rotate the rotating wheel 61 in a completely circular rotation, but moved relative to a first and second position relative to the sliding bars. For example, in one embodiment, the sliding bars 51 slide in forward and rear directions along the rollers 511. At this time, the front end portions 311 of the stepping bars 31 are forced to push the swinging portions 212 of the respective swing arms 21, to cause the swing arms 21 to turn about the transverse axle 121. Subject to the arrangement of the travel path constraining unit 40, the stepping bars 31, the swing arms 21 and the handlebars 81 are moved within a predetermined travel path that is limited by the upper crank arms 42 and the links 43, avoiding component damage due to overswinging of the swing arms 21 and the stepping bars 31. Further, as illustrated in FIG. 5, subject to the arrangement that the turntable 71 is fixedly fastened to one upper crank arm 42, when the tubular pivot connection portions 211 of the swing arms 21 are biased relative to the transverse axle 121, the lug members 213 are alternately turned forward and backward to move the respective links 43 and the respective upper crank arms 42, and thus, the turntable 71 of the second damping unit 70 is rotated back and forth relative to the friction device 72. Because the brake linking 724 is abutted against the peripheral wall 712, a damping resistance is produced during rotation of the turntable 71. Thus, the second damping unit 70 can provide a damping resistance to the swing arms 21 to enhance the exercising effects.

Further, the user can operate the adjustment member 723 of the second damping unit 70 to adjust the abutting force of the brake lining 724 against the peripheral wall 712, thereby adjusting the damping resistance.

When the user uses the exercise apparatus to carry out an operating mode of elliptical trajectory, the user's legs are used to force the pedals 32 and the stepping bars 31 horizontally forwards and vertically downwards in an alternating manner. During this operating mode, the first damping unit 60 and the second damping unit 70 respectively provide a damping resistance to the stepping bars 31 and the swing arms 21, achieving a better exercising effect.

Thus, the user can use the exercise apparatus to selectively carry out different operating modes according to personal needs, such as the operating mode of elliptical trajectory, the operating mode of sliding exercise, or the simple operating mode of free stepping.

It's worth mentioning that in the above-described preferred embodiment of the present invention, the center line L of the screw rod 721 of the second damping unit 70 is parallel to the end faces 711 of the turntable 71 for enabling the friction pad 722 to rub against the peripheral wall 712 for producing a damping resistance, however, this design is not a limitation. Actually, if the center line of the screw rod is disposed perpendicular to the end faces, and the friction pad is disposed to abut against one end face, the same exercise effect can be achieved.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An exercise apparatus, comprising:

a base frame comprising a base and an upright support fixedly mounted at said base;

a swing unit comprising a pair of swing arms pivotally connected to said upright support and swingeable back and forth relative to said upright support, each said swing arm comprising a tubular pivot connection portion pivotally connected to said upright support and a swinging portion opposite said tubular pivot connection portion;

a pedal unit comprising a pair of stepping bars respectively pivotally connected to said swing arms, each said stepping bar comprising a front end portion pivotally connected to a respective swinging portion and a rear end portion opposite said front end portion;

a travel path constraining unit comprising a pivot axle rotationally mounted to said base frame, a pair of upper crank arms respectively connected to two opposite ends of said pivot axle in a way to move in opposite directions, and a pair of links respectively pivotally connected between said upper crank arms and said tubular pivot connection portions of said swing arms;

a first damping unit mounted at said base frame and adapted for providing a damping resistance to said stepping bars; and a second damping unit mounted at said upright support and adapted for providing a damping resistance to said swing arms.

2. The exercise apparatus as claimed in claim 1, wherein said second damping unit comprises a friction disc connected to at least one of said upper crank arms, and a friction device configured to rub against said friction disc to generate a damping resistance, said friction device being positionable relative to said base frame.

3. The exercise apparatus as claimed in claim 2, wherein said upright support of said base frame comprises a locating bar; said friction device of said second damping unit being adjustably screw-connected to said locating bar, the friction device comprising a friction pad facing toward said friction disc and an adjustment member opposite said friction pad, said adjustment member being operable to move said friction pad toward or away from said friction disc.

4. The exercise apparatus as claimed in claim 3, wherein said friction device of said second damping unit further comprises a screw rod mounted in said locating bar and extending along a center line; wherein said adjustment member and said friction pad are respectively disposed at two opposite ends of said screw rod; wherein said friction disc comprises two opposing end faces disposed parallel to said center line and a peripheral wall connecting said two end faces; said friction pad being adapted for abutting against said peripheral wall.

5. The exercise apparatus as claimed in claim 3, wherein said upright support of said base frame further comprises an extension bar located at a bottom side of said locating bar; said pivot axle of said travel path constraining unit being pivotally connected to said extension bar; said friction disc being a hollow disk disposed at one side relative to said extension bar and comprising a through hole that receives said pivot axle.

6. The exercise apparatus as claimed in claim 1, further comprising an interlocking unit, wherein said base frame further comprises a mount mounted at said base opposite to said upright support; said first damping unit comprises a rotating wheel pivotally mounted in said mount and a damping wheel pivotally mounted in said mount and rotatable by said rotating wheel, said rotating wheel comprising a rotating axle axially pivotally connected to said mount; said interlocking unit comprising a pair of sliding bars supported on and slidable along said base, and a pair of rear crank arms respectively mounted at two opposite ends of said rotating axle and respectively pivotally connected to said rear crank arms of said sliding bars; each said sliding bar comprising a roller rotatably abutted against a bottom side of the respective stepping bar.

7. The exercise apparatus as claimed in claim 6, wherein said base of said base frame comprises a front side supporting said upright support, an opposite rear side supporting said mount, and a pair of guide rails connected between said front side and said rear side; each said sliding bar of said interlocking unit further comprises a pulley supported on and slidable along a respective guide rail.

* * * * *